US011524869B2

(12) United States Patent
Studer et al.

(10) Patent No.: US 11,524,869 B2
(45) Date of Patent: Dec. 13, 2022

(54) METHOD FOR MONITORING AN ELEVATOR SYSTEM

(71) Applicant: Inventio AG, Hergiswil (CH)

(72) Inventors: Christian Studer, Kriens (CH); Martin Kusserow, Lucerne (CH); Reto Tschuppert, Lucerne (CH); Zack Zhu, Baar (CH)

(73) Assignee: INVENTIO AG, Hergiswil NW (CH)

( * ) Notice: Subject to any disclaimer, the term of this patent is extended or adjusted under 35 U.S.C. 154(b) by 945 days.

(21) Appl. No.: 16/330,506

(22) PCT Filed: Sep. 4, 2017

(86) PCT No.: PCT/EP2017/072104
§ 371 (c)(1),
(2) Date: Mar. 5, 2019

(87) PCT Pub. No.: WO2018/050470
PCT Pub. Date: Mar. 22, 2018

(65) Prior Publication Data

US 2019/0193992 A1 Jun. 27, 2019

(30) Foreign Application Priority Data

Sep. 13, 2016 (EP) ..... 16188445

(51) Int. Cl.
*B66B 5/00* (2006.01)

(52) U.S. Cl.
CPC ..... *B66B 5/0025* (2013.01)

(58) Field of Classification Search
CPC ..... B66B 5/0025; B66B 13/14; B66B 13/143; B66B 1/3492
See application file for complete search history.

(56) References Cited

U.S. PATENT DOCUMENTS

2013/0332064 A1* 12/2013 Funk ..... G01C 21/165 701/409
2014/0330535 A1* 11/2014 Van Den Heuvel ... G01C 21/16 702/141
2015/0284214 A1* 10/2015 Park ..... B66B 5/0025 187/393
2016/0130114 A1* 5/2016 Wilke ..... B66B 5/0025 187/393
2016/0185569 A1* 6/2016 Sonnenmoser ..... B66B 5/0018 187/393

(Continued)

FOREIGN PATENT DOCUMENTS

CN 1498842 A 5/2004
CN 1759613 A 4/2006

(Continued)

*Primary Examiner* — Michael A Riegelman
(74) *Attorney, Agent, or Firm* — William J. Clemens; Shumaker, Loop & Kendrick, LLP

(57) ABSTRACT

A method for monitoring an elevator system utilizes a mobile terminal device having at least one sensor to collect measurement values in an elevator car. The mobile terminal device is carried by a passenger of the elevator system. The collected measurement values are transmitted by the mobile terminal device to a central evaluation unit where they are evaluated. The mobile terminal device activates a measurement mode when it detects that it is located in a region of a shaft door of the elevator system.

15 Claims, 3 Drawing Sheets

(56) References Cited

U.S. PATENT DOCUMENTS

| | | | | |
|---|---|---|---|---|
| 2017/0225921 | A1* | 8/2017 | Scoville | B66B 5/0018 |
| 2017/0334678 | A1* | 11/2017 | Sonnenmoser | B66B 5/0031 |
| 2019/0185293 | A1* | 6/2019 | Yang | H04W 4/021 |
| 2019/0193986 | A1* | 6/2019 | Studer | B66B 1/3492 |
| 2019/0193992 | A1* | 6/2019 | Studer | B66B 5/0025 |
| 2020/0002124 | A1* | 1/2020 | Wirola | B66B 1/468 |
| 2021/0032078 | A1* | 2/2021 | Chiappa | B66B 5/0087 |
| 2021/0238010 | A1* | 8/2021 | Kusserow | B66B 5/02 |
| 2021/0395038 | A1* | 12/2021 | Wong | B66B 1/2408 |
| 2022/0098004 | A1* | 3/2022 | Studer | B66B 1/3446 |

FOREIGN PATENT DOCUMENTS

| | | | |
|---|---|---|---|
| CN | 101253756 | A | 8/2008 |
| CN | 105452138 | A | 3/2016 |
| JP | 2002037561 | A | 2/2002 |
| JP | 2006096517 | A | 4/2006 |
| JP | 2015003785 | A | 1/2015 |
| KR | 101394380 | B1 | 5/2014 |

* cited by examiner

METHOD FOR MONITORING AN ELEVATOR SYSTEM

FIELD

The invention relates to a method for monitoring an elevator system using a mobile terminal device.

BACKGROUND

US 2016/0130114 A1 describes a method of monitoring an elevator system in which a passenger with a mobile terminal device, for example a mobile telephone or smartphone, in an elevator car can take measurements and transmit them to a central evaluation unit for evaluation. The mobile terminal device for this purpose has a sensor in the form of a microphone which can pick up sounds of the elevator system during a trip of the elevator car. For this purpose, the passenger starts a program in the mobile terminal device by means of which the measurements can be started and transmitted to the evaluation unit. The passenger taking the measurements can be for example a service technician, and in-house technician, or some other user of the elevator system.

US 2015/0284214 A1 describes a method of monitoring an elevator system which automatically recognizes when an elevator car in an elevator shaft is moved in the vertical direction. As soon as a mobile terminal device identifies movement of the elevator car up or down, collection of the measured variables by sensors of the mobile terminal device is started. So as to activate this method, a user must activate a special mode of the mobile terminal device.

For effective monitoring of elevator systems, it is important that measurement values from the largest possible number of trips of elevator cars be collected and evaluated by the central evaluation unit. In order to obtain readiness for performing such measurements from as many elevator car passengers as possible, the expense for detection and transmission must be as small as possible.

SUMMARY

Thus, it is in particular the object of the invention to recommend a method which permits very simple monitoring of the elevator system and in particular is very user friendly. In the method according to the invention for monitoring an elevator system, using a mobile terminal device having at least one sensor, measurement values are collected in an elevator car. The mobile terminal device here is in particular carried by a passenger of the elevator system. The collected measurement values are transmitted by the mobile terminal device to a central evaluation unit, by which they are evaluated. According to the invention the mobile terminal device activates a measurement mode when it detects that it is in the region of a shaft door of the elevator system. The measurement mode is thus automatically activated when the passenger carrying the mobile terminal device is with very high probability in an elevator car shortly before a trip, and the mobile terminal device thus has been brought into an elevator car in which it can collect the measurement values. This can ensure that in every trip in an elevator car taken by a passenger, measurement values can be collected and subsequently transmitted to the evaluation unit. If the mobile terminal device cannot be brought into an elevator car, however, the measurement mode can also be again deactivated after a determinable waiting period.

"In the region of a shaft door" in this context means the stay in a spatial region in front of a shaft door. The region is in particular selected such that a person actually only stays in the region when they want to enter an accessible elevator car. The limits of said region can for example be a distance of one to three meters around the shaft door.

The mobile terminal device recognizes that it is located in the region of a shaft door of the elevator system before the passenger enters an elevator car through an open shaft door. The measurement mode of the mobile terminal device is thus already activated before the mobile terminal device is brought into the elevator car and thus before or a trip of the elevator car begins in which the elevator car and thus the mobile terminal device are accelerated in the vertical direction, thus upward or downward.

The recognition that the mobile terminal device is located in the region of the shaft door of an elevator system can also be effected in a different manner. The mobile terminal device can for example evaluate measurement values of one or more sensors or receive the signal from a positional information device. Activation of the measurement mode in this context should be understood to mean that the terminal device for detecting measurement values is made ready, thus for example a measurement program, in particular in the form of a so-called app, is started, the already started app is put in a special measurement mode and/or the necessary sensors are activated for the measurement. The detection of measurement values need not be but can already be started during activation of the measurement mode. Detection of measurement values can be started for example depending on further conditions.

Thus, the mobile terminal device, without the need for manual action especially from the passenger can be put in measurement mode and thus can be made ready for detection of measurement values of the elevator system. The method that is thus very simply executable and very user-friendly.

Nowadays very many people and thus also many passengers carry a mobile terminal device with sensors with them for example in the form of a mobile telephone or smartphone. By using these terminal devices which in any case are carried with them to detect the measurement values, no additional hardware is stated. The monitoring of an elevator system according to the invention is thus also feasible at low cost.

Monitoring of an elevator system in this context should be understood to mean that operation of the elevator system is monitored such that for example errors are identified and/or a need for maintenance of the entire elevator system or individual components can be identified. A system that performs such monitoring is frequently termed a remote monitoring system.

The mobile terminal device can for example be in the form of a mobile telephone, a smartphone, a tablet computer, a smart watch, a so-called wearable for example in the form of an electronic smart textile or some other portable terminal device. The sensor of a mobile terminal device can be for example a microphone, an acceleration sensor, a rotational speed sensor, a magnetic field sensor, a camera, a barometer, a brightness sensor, an air humidity sensor, or a carbon dioxide sensor. The acceleration sensor, rotational speed, and magnetic field sensors are in particular designed as so-called three-dimensional or 3-D sensors. Such sensors provide three measurement values in the x-, y-, and z-direction, wherein the x-, y-, and z-directions are arranged perpendicular to one another. The terminal device in particular has several and especially different types of sensors, thus for example a microphone, a three-dimensional acceleration sensor, a three-dimensional rotational speed sensor, and a three-dimensional magnetic field sensor. Below acceleration sensors, rotational speed sensors, and magnetic field sensors are understood to mean three-dimensional acceleration sensors, rotational speed sensors, and magnetic field sensors.

The passenger may be carrying the terminal device in quite varied orientations so that at first it is not clear how the acceleration, rotational speed, or magnetic field sensors are oriented in space. But since the gravitational acceleration is always measured, at least when the passenger does not move, the vertical direction, thus the absolute z-direction, can be unequivocally determined from this. With knowledge of the absolute z-direction, the measurement values of the acceleration, rotational speed, and magnetic field sensors can be converted to values that are oriented along the absolute z-direction and absolute x-direction and y-direction. Here the absolute x-, y-, and z-directions are arranged respectively perpendicular to one another. All of the following statements regarding accelerations, rotational speeds, or magnetic field intensities relate to measurement values and statements about x-, y-, and z-directions. Instead of defining the values in absolute x-, y-, and z-directions, the three measurement values can be considered as vectors and a resultant vector can be formed from the individual vectors. Instead of using the three individual measurement values, the resultant vector can also be used.

The central evaluation unit in particular is a server which receives and evaluates a plurality of mobile terminal devices and elevator systems. In particular it is arranged remotely from the elevator system from which the measurement data is collected. The central evaluation unit can be operated for example by a company that is responsible for maintenance of elevator systems, thus in particular by a producer of elevator systems. The central evaluation unit using the measurements values of an elevator system can generate a problem or an error, for example a sluggish car or shaft door, and generate a corresponding report that then triggers examination of the elevator system by a service technician.

The mobile terminal device transmits the measurement values in particular wirelessly to the central evaluation unit. In particular the transmission takes place over the Internet, wherein the measurement values can be sent directly from the mobile terminal device to the central evaluation unit or indirectly, thus with intermediate connection by one or more switching stations. Apart from wireless transmission however, cable transmission is also conceivable. The transmission occurs in particular after the end of the trip in the elevator car. The measurement data thus in particular is stored by the mobile terminal device and after conclusion of detection is transmitted to the central evaluation unit. For example, the transmission can occur directly after conclusion of detection. Since inside of buildings there may be problems with Internet connections, the transmission may also occur later on, thus only after the passenger has left the building with the elevator system. Here in addition collected measurement data from more than one trip in an elevator car can be transmitted to the central evaluation unit.

In one embodiment of the invention the mobile terminal device activates the measurement mode when it recognizes that it is located inside an elevator car. The measurement mode is thus activated when the passenger enters an elevator car with the mobile terminal device. This effectively prevents the mobile terminal device from being switched to the measurement mode when it is unnecessary, thus when it is brought into a region close to a shaft door but ultimately is not brought into an elevator car. The detection of whether the mobile terminal device is located inside an elevator car can in principle proceed in the same way as detection of whether it is located in the region of the shaft door. Below the term "in the region of a shaft door of the elevator system" should also be understood as "in the elevator car."

In one embodiment of the invention in order to determine its position the mobile terminal device receives a signal from a positional information device and evaluates it. From receipt of said signal the mobile terminal device can infer its location and thus decide whether it is located in the region of a shaft door. Analogously the entering and leaving of the elevator can also be identified.

The signal can be configured such that it can only be received by the mobile terminal device when the mobile terminal device is in the region of a shaft door. In this case the evaluation is limited to a test of whether the signal can be received or not. It is also possible that two different signals can be received and from the simultaneous receipt of both signals it can be inferred that the mobile terminal device is in the region of the shaft door. It is also possible that the signal has to be received with a predetermined signal strength in order to ascertain that the mobile terminal device is in the region of the shaft door. In this case in the evaluation, the signal strength is compared with a threshold value.

The positional information device can be designed for example as a so-called beacon and thus as a transmitter that transmits radio signals. For example, the beacon can transmit an identifying signal for the region of the shaft door or in an elevator car. It is also possible that the beacon transmits a signal that identifies its position within the building. From this position the mobile terminal device can deduce whether it is in the region of a shaft door. The positional information device can also be designed a different way, for example as a WLAN transmitter, a Bluetooth transmitter, or some other transmitter which transmits assessable signals. It is also possible that components of the elevator system, for example elevator controls or door controls transmit the corresponding signals. The signal can be configured for example as a tone in a frequency range which cannot be perceived by humans.

In one embodiment of the invention the mobile terminal device determines its position inside a building having an elevator system and from this deduces whether it is in the region of a shaft door of the elevator system. In this way it can also be detected whether the terminal device is inside an elevator car. The mobile terminal device thus has a so-called indoor navigation system that is active as a program or app in the mobile terminal device. Such indoor navigation systems evaluate for example signals from WLAN transmitters or beacons within the building and can thus determine the position of the terminal device within the building. If this is the case, the terminal device activates the measurement mode. Since indoor navigation devices permit very precise determination of position within a building, it can be determined with very high probability whether the terminal device is in the region of a shaft door. The detection of whether the terminal device is in the region of the shaft door is thus very reliable. In an analogous manner, the leaving of an elevator car can also be detected.

In one embodiment of the invention the mobile terminal device receives information concerning its position within a building having an elevator system from a position determination system and deduces from this whether it is located in the region of the shaft door of the elevator system. In the same manner it can also be detected whether the terminal device is located within an elevator car. In this case the building in which the elevator system is installed is equipped with a positional determination system that can identify the location of the mobile device. This positional determination system transmits information concerning the position of the terminal device to the terminal device. This information can relate to the position within the building and the terminal device can compare the position with a map of the building and from this deduce whether it is located in the region of a shaft door. It is also possible that the positional determination system transmits the corresponding information directly to the terminal device when it is located in the region of the shaft door. The detection of whether the terminal device is located in the region of the shaft door is thus very reliable. In an analogous manner the leaving of an elevator car can also be detected.

In one embodiment of the invention the mobile terminal device detects measurement values with at least one sensor which define movements of the mobile terminal device and based on these measurement values detects whether it is located in the region of the shaft door of the elevator system. In this manner it can also be detected whether the terminal device is located within an elevator car. In particular measurement values of the above-described sensors of the terminal device can be evaluated. Thus, no additional hardware is needed for detecting whether the terminal device is located in the region of the shaft door. The method according to the invention is thus feasible and economical. In an analogous manner the leaving of an elevator car can also be detected. The leaving basically proceeds in the opposite sequence as entering an elevator car.

The evaluation of the detected data and thus the identification of an entry of the elevator car is in particular performed by the mobile terminal device. It is also possible however that the detected data is transmitted continuously to the central evaluation device and the determination of whether the terminal device is located in the region of a shaft door is made by the evaluation device. In addition, it is possible that at least a part of the evaluation of the detected data is made both by the mobile terminal device and by the evaluation device. Thus, mutual monitoring and/or supplementation is possible, which permits very high precision for determining whether the terminal device is located in the region of a shaft door.

In one embodiment of the invention a motion pattern of the mobile terminal device is deduced from the measurement values and compared with at least one stored signal pattern. The determination of whether the terminal device is located in the region of the shaft door is made on the basis of said comparison. Thus, it can be especially reliably determined whether the terminal device is located in the region of the shaft door.

In this case said stored signal patterns are motion patterns. In this context the motion pattern for example is understood to be a chronological sequence in particular of accelerations or speeds of rotation. The motion pattern can also be described with a so-called feature or in particular several features. Such features can be for example statistical variables such as average values, standard deviations, minimal/maximal values, or results of a fast Fourier analysis of said accelerations or rotational speeds. A motion pattern in this case can also be termed as a so-called feature vector. Said features can in particular be determined for individual chronological segments, wherein in particular individual measurement values are made on the basis of values or processes. For example, such a chronological segment can also be characterized by the fact that the passenger does not move, thus is waiting for example in front of the shaft door. In particular not just one acceleration or rotational speed is considered, but the combination of several accelerations and/or rotational speeds, in particular of three accelerations and rotational speeds each.

A stored signal pattern can include for example characteristic processes of accelerations, rotational speeds, and/or magnetic fields or features during walking of a person to a shaft door, waiting in front of the shaft door until the elevator car is available and entry is possible, entry of the elevator car and turning around in the direction of the car door. The signal patterns can be obtained by specialists on the basis of their experience or in particular determined by one or more experiments. To recognize or classify motion patterns, in particular methods of so-called machine learning are used. For example, a so-called support vector machine, a Random Forest algorithm, or a Deep Learning algorithm is used. These classification methods must initially be taught. For this purpose, in experiments for the approach to a shaft door and or entry of the elevator, typical motion patterns, in particular based on the said features, are produced and made available to the so-called training algorithms. After the algorithms have been taught with a sufficient number of training patterns, they can decide whether an unknown motion pattern defines an approach to a shaft door or entry of the elevator car or not.

The production of the typical motion patterns for the training can be carried out by passengers using the mobile terminal device on a daily basis. For this purpose, they must identify only the start and end of the approach to a shaft door or entry of an elevator car. It is also possible that after conclusion of the actual training the passenger sends a return message as to whether an approach to a shaft door or entry of an elevator car was falsely identified. These return messages can be used for further training of the algorithm.

Since not all persons move in the same way, for instance they turn around at different speeds and for example the waiting times are a different length, the measured motion pattern must be compared in particular not only with one signal pattern but with a series of slightly different signal patterns.

In one embodiment of the invention the mobile terminal device detects measurement values using at least one sensor which values identify an activity of the elevator system. Proceeding from these measurement values the terminal device determines whether it is located in the region of a shaft door of the elevator system. Activities of the elevator systems should be understood here for example as emissions of individual components of the elevator system such as emissions of the elevator car, a shaft door, a car door, or control of a door drive. The terminal device in particular detects sounds and/or magnetic fields wherein specifically three magnetic fields are measured in the x-, y-, and z-directions. The changes of the measured magnetic fields can be provoked for example by the activity of the door drive which has an electric motor and/or by car and/or shaft doors which have ferromagnetic material. It can be concluded from said measurement values for example that the car door of an elevator car is opened in front of the passenger and is closed behind him.

In one embodiment of the invention, an activity pattern is deduced from the measurement values and compared with at least one stored signal pattern. The determination of whether the terminal device is located in the region of the shaft door is made on the basis of said comparison. Thus, it can be especially reliably determined whether the terminal device is located in the region of the shaft door.

Said stored signal patterns in this case are in this case activity patterns. In this regard, an activity pattern should for example be understood as a chronological sequence in particular of measured sounds and/or magnetic fields. An activity pattern can also be described with a feature or in particular several features described in connection with a motion pattern. In particular, not only a single measurement of a magnetic fields in one direction is considered, but the combination of several measurements of magnetic fields in several, in particular three directions.

A signal pattern can for example describe a sound of a car door on opening or a sound when the elevator car arrives a floor, or features deduced therefrom. The signal patterns can be created by specialists on the basis of their experience or in particular determined by one or more experiments. To determine the signal patterns, analogously to the above description in connection with the melting points, in particular the method of so-called machine learning is applied. The signal patterns can likewise be divided into chronological segments and individual features determined for each segment.

Since similar activities of elevators, such as for example the opening of the car door, can vary, thus for example they can last for varying lengths of time, the measured activity pattern can in particular not be compared with only one signal pattern, but with a whole series of slightly different signal patterns.

In an embodiment of the invention, the mobile terminal device with the sensor detects measurement values that identify the properties of the environment of the mobile terminal device and based on these measurement values determines whether it is located in the region of a shaft door of the elevator system or inside an elevator car. For example, magnetic fields, air pressure, brightness, humidity, or carbon dioxide content of the air can be measured.

In an embodiment of the invention, a property pattern is deduced from the measurement values and compared with at least one stored signal pattern. The determination whether the terminal device is located in the region of a shaft door or within an elevator car is made on the basis of said comparison.

In said stored signal patterns, in this case it is property patterns. In this regard, a property pattern for example is understood as a chronological sequence of measurement values which describe the environment of the terminal device, thus in this case the properties of the elevator system. A property pattern can also be described with a feature described in connection with motion patterns or in particular several features. In particular, not only the course of a signal measurement of one of said properties is considered, but the combination of several measurements.

For example, a signal pattern can describe the change in a magnetic field from the outside to the inside of the elevator car or features deduced therefrom. Changes of the magnetic field can for example be induced by different use of ferromagnetic materials or different electrical components, such as for example coils outside and inside the elevator car. The ferromagnetic materials themselves can produce magnetic fields and/or influence the earth's magnetic field.

A signal pattern for example can describe the change of CO2 content of the air from outside to inside of the elevator car or features deduced therefrom. The CO2 content of the air increases due to the air breathed out by the passengers in the closed elevator car. Thus, in general the CO2 content of the air in the car is higher than outside. In addition, the CO2 content rises slowly during the trip, from which a trip in an elevator car can be detected. This increase is a rather slow process but can be detected during longer trips.

A signal pattern can for example describe the change in the humidity from outside to inside of the elevator car or features deduced therefrom. This increases slowly, analogously to the CO2 content, inside the car due to the air breathed out by the passengers, so that the evaluation can proceed analogously to the CO2 content.

A signal pattern can for example describe the change in the temperature from outside to inside of the elevator car or features deduced therefrom. Due to the heat given off by the passengers, the temperature slowly increases, so that the evaluation can proceed analogously to the CO2 content.

A signal pattern can for example describes the change of brightness from outside to inside the elevator car or features deduced therefrom. As a rule, it is less bright inside an elevator car.

A signal pattern can for example describe the change in acoustics from outside to inside the elevator car or features deduced therefore. Since an elevator car is a comparatively close and closed-off space, for example the echo or sound deadening is changed. In particular, test signals can be used to determine this change.

The signal patterns can be created by specialists on the basis of their experience, or in particular by one or more experiments. To determine the signal patterns, analogously to the above description, in connection with motion patterns in particular the method of so-called machine learning can be applied. The signal patterns can likewise be divided into chronological segments and individual features determined for each segment.

Since not all elevator cars have identical property patterns, but the latter can vary, the measured property pattern is compared not only with one signal pattern, but with a whole series of slightly different signal patterns.

For the determination of whether the terminal device is located in the region of a shaft door or inside an elevator car, in particular not only measurement values identifying each individual motion of the passenger, measurement values identifying the activities of the elevator car, or measurement values identifying the properties of the elevator car are detected and evaluated, but a combination of these different types of measurement values. Thus, in particular it can be reliably recognized whether the terminal device is located in the region of a shaft door or inside an elevator car.

In one embodiment of the invention, the mobile terminal device with activation of the measurement mode also starts the measurement of measurement values. Measurement in this context should be understood to mean that the mobile terminal device stores the collected measurement values in order to transmit them to the evaluation device. The measurement can also for example be concluded after a fixed period of time. Thus, the method can be especially simply implemented. The central evaluation unit can leave uninteresting measurements detected prior to the stop of the elevator car out of the evaluation. In addition, the evaluation unit can recognize a trip of the elevator car for example based on the collected measurement data. This can be obtained for example on the basis of the measured accelerations and air pressures.

In one embodiment of the invention the mobile terminal device starts or concludes the measurement of measurement values based on an external signal. This external signal for example be transmitted from an elevator control unit at the start and end of a trip of an elevator car to the mobile terminal device. Thus, it is possible to detect, store, and transmit to the central evaluation unit only measurement values relative to the evaluation. Thus, less data must be stored, transmitted, and evaluated. The mobile terminal device in particular is configured such that it only reacts to said external signal when it is in measurement mode.

The external signal can for example also be sent at the start of a trip and contain information about the anticipated duration of the upcoming trip. It is also possible that the external signal is transmitted before the start of the trip and contains information about how long it will be before the start of the trip. In addition, here also the anticipated duration of the trip can be sent.

In one embodiment of the invention, the mobile terminal device already in the measurement mode, by means of at least one sensor, monitors the measurement values that identify movements of the mobile terminal device. It begins the measurement of measurement values when one start condition dependent on at least one measurement value is fulfilled and/or ends the detection of measurement values when an end condition dependent on at least one measurement value is fulfilled. Thus, it is possible to detect, store, and transmit to the central evaluation unit only the measurement values relevant for the evaluation. Thus, less data has to be stored, transmitted, and evaluated.

A trip of an elevator car leads to characteristic behaviors of one or more measurement values. For example, a characteristic behavior follows from the acceleration in a vertical direction. The elevator car is initially accelerated upward or downward, then travels usually for a while at quasi constant speed, and is then braked to a standstill. Thus, it can be a starting condition for example that the amount of acceleration in the vertical direction or the amount of the above described resultant acceleration vector exceeds a first threshold value. An ending condition could then for example be that the amount of oppositely oriented acceleration exceeds a second threshold value.

Alternatively, or additionally, the air pressure measured by a barometer can be evaluated to recognize a trip in an elevator car. The trip in the vertical direction alters the air pressure, wherein the gradient of the change is markedly greater than when climbing stairs or due to weather-related changes in the air pressure. A starting condition can thus for example be that the magnitude of the gradient of the air pressure exceeds a first threshold value. An ending condition could then for example be that the magnitude of the gradient of the air pressure is below a second threshold value.

Further advantages, features, and details of the invention follow from the following description of exemplary embodiments and from the drawings in which the same elements or elements of similar function are provided with identical reference symbols.

DETAILED DESCRIPTION

Figure 1:
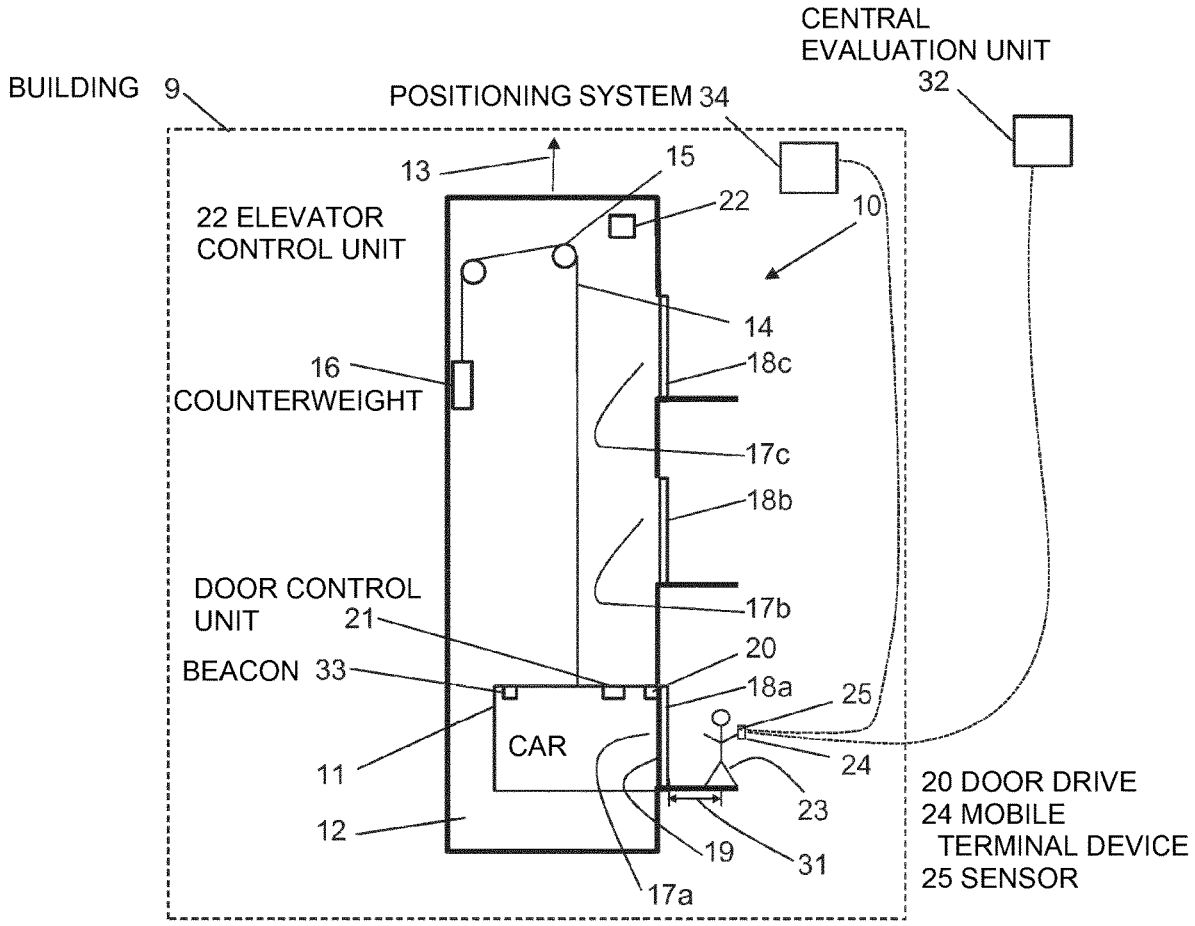
FIG. 1 shows a schematic representation of an elevator car with one passenger.

According to FIG. 1, an elevator system 10 has an elevator car 11 which can move in an elevator shaft 12 in a vertical direction 13 up and down. The elevator system 10 is arranged in a building 9 depicted only symbolically as a rectangle. In addition, the elevator car 11 is connected via a flexible support means 14 and a drive roller 15 of a drive not further shown to a counterweight 16. Via the drive roller 15 and the support means 14, the drive can move the elevator car 11 and the counterweight 16 in opposite directions up and down. The elevator shaft 12 has three shaft openings 17*a*, 17*b*, and 17*c* and thus three floors, which are closed with the shaft doors 18*a*, 18*b*, and 18*c*. FIG. 1 shows the elevator car 11 and the shaft opening 17*a*, thus at the lowest floor. When the elevator car 11 is located at a floor, i.e. at one of the shaft openings 17*a*, 17*b*, or 17*c*, the corresponding shaft door 18*a*, 18*b*, or 18*c* together with a car door 19 can be opened and thus the elevator car 11 can be entered. To open the car door 19 and the corresponding shaft door 18*a*, 18*b*, or 18*c*, the door segments, not further shown, are pushed aside, so that the door segments are displaced to the side. The car door 19 and the corresponding shaft door 18*a*, 18*b*, or 18*c* are actuated by a door drive 20, which is controlled by a door control unit 21. The door control unit 21 is in signal connection with an elevator control unit 22, which controls the entire elevator system. The elevator control unit 22 controls the drive, for example, and can thus move the elevator car 11 to a desired floor. For example, it can transmit a command to the door control unit 22 to open the car door 19 and the corresponding shaft door 18*a*, 18*b*, or 18*c*, which the door control unit 21 then executes by means of corresponding control of the door drive 20.

At the lowest floor, thus in front of shaft door 18*a*, stands a passenger 23 who carries a mobile terminal device in the form of a mobile telephone 24. The mobile telephone 24 has several sensors 25, of which only a microphone is depicted. The mobile telephone 24 in addition has three-dimensional acceleration-, rotational speed-, and magnetic fields sensors, which can detect measurement values in the x-, y-, and z-directions. As explained above, the measurement values detected by the acceleration-, rotational speed-, and magnetic fields sensors can be simply converted into values with respect to absolute x-, y-, and z-directions. All of the following statements concerning accelerations, rotational speeds, or magnetic field intensities thus relate to measurement values and statements regarding x-, y-, and z-directions converted in this way to absolute x-, y-, and z-directions.

Measurement values detected on the basis of the sensors of the mobile telephone 24 should be determined when the passenger 23 enters a region 31 in front of the shaft door 18*a* and the mobile telephone 24 is thus in the region 31 of the shaft door 18*a*. The mobile telephone 24 thus is located in the region 31 of the shaft door. The region 31 extends to a distance of 1.5 m from the shaft door 18*a*, for example. In addition, it should be determined when the passenger 23 enters the elevator car 11 and the mobile telephone 24 is thus in the elevator car 11. The mobile telephone 24 in addition detects ongoing measurement values and evaluates same. The mobile telephone 24 detects the rotational speeds about the x-, y-, and z-axis, for example. These measured rotational speeds identify not only motions of the mobile telephone 24, but also motions of the passenger 23. Measurement values are detected continuously and a continuing motion pattern of the passenger 23 is produced by combining the individual measurement values of the different accelerating sensors. The measurement values here are in particular filtered by means of a low-pass filter. Said motion pattern thus contains in this case the behaviors of the rotational speeds about the x-, y-, and z-axis. The mobile telephone 24 compares the continuing motion pattern thus produced with stored signal patterns which are typical of the motion pattern on approaching a shaft door of an elevator system and on entering an elevator car 11. In order to be able to make the comparison, features in the form of averages, standard deviations, and minimal/maximal values of the individual rotational speeds or chronological segments of the rotational speeds are determined and compared with the stored values. If the differences between the features of the measured behaviors and the stored features are smaller than determinable threshold values, adequate agreement of a motion pattern with a stored signal pattern is recognized. From this the mobile telephone 24 infers that the passenger 23 has entered the region 31 of the shaft door 18*a* and the elevator car 11.

As soon as the mobile telephone 24 recognizes that it is in the region of the shaft door 18*a*, or at the latest when it recognizes that it is located in the car 11, it activates a measurement mode in which it is ready for measurements during the upcoming trip in the elevator car 11 for monitoring the elevator system 10. Toward this end the mobile telephone 24 starts a special app and puts it in measurement mode so that only a start signal is needed for detecting measurement data. In addition, the sensors needed for the determination are also activated and undergo a function test. The definition of which sensors are to detect which measurement values at what sampling rate is loaded in the app.

The measurement of the measurement value can be started at the same time as activation of the measurement mode of the mobile telephone 24, and continued for a time period of 60-240 s for example, which is stored in the app. After completion of measurement of the measurement values, the mobile telephone 24 transmits the collected measurement values to a central evaluation unit 32. The transmission takes place in particular via the Internet, since a transmission from the elevator car 11 or even from the building 9 in which the elevator system 10 is located can be problematic. The mobile telephone 24 stores the collected measurement data therefore until a transmission to the evaluation unit 32 is possible. The evaluation unit 32 tests using the collected measurement data whether there is a fault in the elevator system 10 or if maintenance of the elevator system 10 should be done.

The comparison between a measured motion pattern and a stored signal pattern and thus the recognition or classification of motion patterns can also be carried out with methods of so-called machine learning. For example, a so-called Support Vector Machine, a Random Forest Algorithm, or a Deep Learning Algorithm can be used.

In addition, transversal accelerations in the x-, y-, and z-directions can also be considered, so that the motion pattern also contains the behaviors of the accelerations in the x-, y-, and z-direction.

It is also possible that the mobile telephone 24 completely identifies entry of an elevator car 11 not entirely alone, but transmits the detected data to the evaluation unit even before the measurement of measurement data. In addition, intermediate stations not shown in the building 9 can be present in the region of the elevator system 10, which reliably allow forwarding of the measurement data to the evaluation unit 32. The detection of entry of the elevator car 11 is then carried out by the evaluation device 32. As soon as entry of the region 31 of the shaft door 18*a* or entry of the elevator car 11 is detected, the evaluation device 32 transmits a corresponding signal to the mobile telephone 24.

Figure 2A:
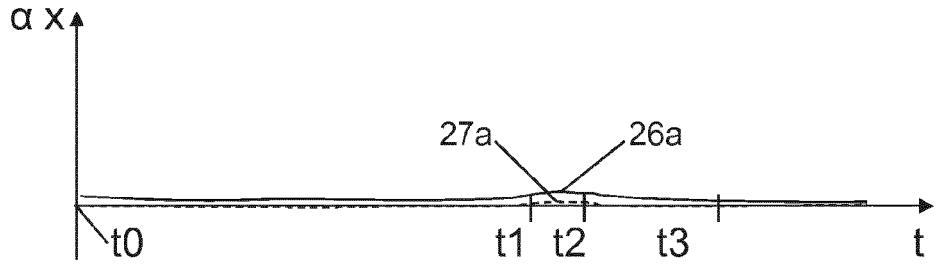
FIGS. 2*a*, 2*b*, 2*c* show chronological behaviors of rotational speeds when a passenger enters an elevator car.
Figure 2B:
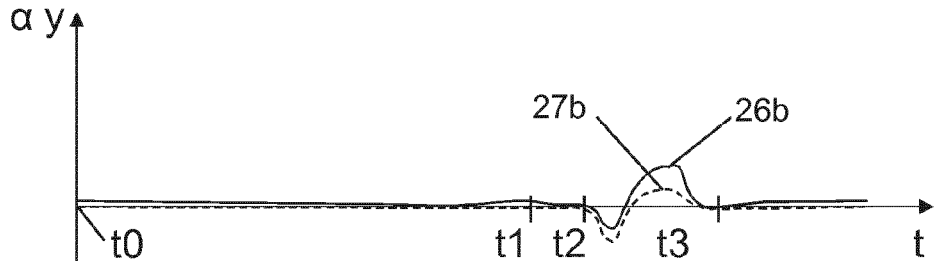
Figure 2C:
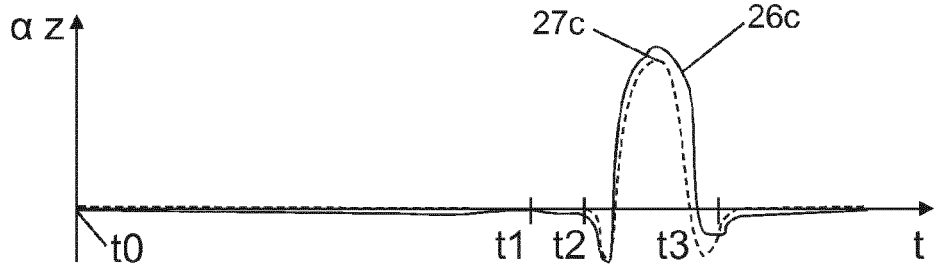

FIGS. 2*a*, 2*b*, and 2*c* depict a measured motion pattern and a stored signal pattern over time, wherein FIG. 2*a* shows the rotational speeds a about the x-axis, FIG. 2*b* about the y-axis, and FIG. 2*c* about the z-axis. The measured rotational speeds in each case are depicted with a solid line and the stored rotational speeds of the signal pattern in each case with a broken line. The solid lines 26*a*, 26*b*, and 26*c* thus represent the measured rotational speeds and the broken lines 27*a*, 27*b*, and 27*c* the stored rotational speeds about the x-, y-, and z-axis. The measured values are shown smoothed out.

The stored signal pattern (broken lines 27*a*, 27*b*, 27*c*) contains typical behaviors of rotational speeds as occur on approach to a shaft door and on entering an elevator car. From the time t0 to the time t1, the passenger approaches the shaft door so as to stop up to time t1, and until time t2 to wait for opening of the shaft and car doors. At this time, hardly any rotational speeds occur. From the time t2 to the time t3, the passenger enters the elevator car and then turns in the direction of the car door. This turning leads first of all to a marked swing in the rotational speeds about the z-axis (line 27*c*), wherein at the start and end of the swing a brief undershooting in the opposite direction occurs. As is plain in FIGS. 2*a*, 2*b*, and 2*c*, the measured motion pattern (solid lines 26*a*, 26*b*, 26*c*) follows quite exactly the stored signal pattern. The comparison of the motion pattern with stored signal patterns proceeds as described above. Based on this agreement, the mobile telephone 24 infers that the passenger 23 is located in the region 31 of the shaft door 18*a*, or has entered the elevator car 11.

Since not all persons move in the same way, in that for example they turn at different speeds, and for example the waiting times are different lengths, the measured motion pattern in particular is not compared with only one signal pattern, but with a whole series of slightly different signal patterns.

Supplementary to the rotational speeds, in addition accelerations in the x-, y-, and z-directions can also be considered in a comparable manner. Thus, in particular running in the direction of the shaft door and into the elevator car, as well as waiting in front of and in the elevator car can be identified more easily.

So as to make entry into a region of a shaft door or an elevator car more reliably detectable, in particular further measurement values detected by sensors of the mobile telephone are evaluated. The mobile telephone 24 in particular detects the magnetic field intensity in the x-, y-, and z-directions using the three-dimensional magnetic field sensor. The measured values thus identify a property of the elevator system. It is only possible with very great difficulty to infer from measurement values at a single time that the mobile telephone and thus the passenger is located in the region of a shaft door or in an elevator car. For this reason, a property pattern is created from the chronological behaviors of the three field intensities, wherein the measured values are in particular filtered by a low pass filter. The mobile telephone 24 compares the continuous property pattern thus produced with the stored signal patterns, which are typical of a property pattern on approaching a shaft door and on entering an elevator car 11. If sufficient agreement of a motion pattern with a stored signal pattern is recognized, the mobile telephone 24 infers from that agreement that the passenger 23 is located in the region 31 of the shaft door 18*a*, or that he has entered the elevator car 11. The comparison of the motion pattern with stored signal patterns proceeds as described above.

Figure 3A:
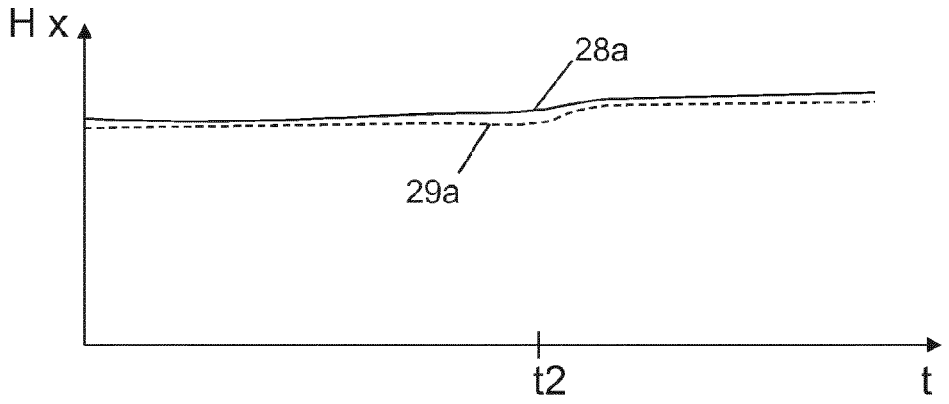
FIGS. 3*a*, 3*b*, 3*c* show chronological behaviors of magnetic fields intensities when a passenger enters an elevator car.
Figure 3B:
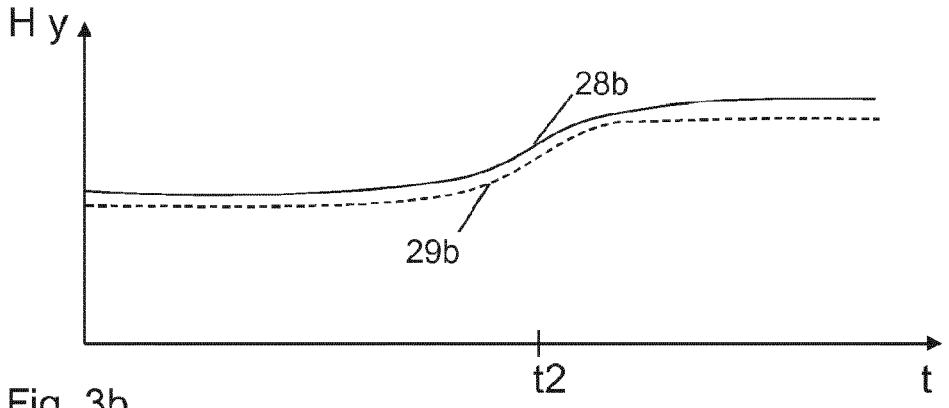
Figure 3C:
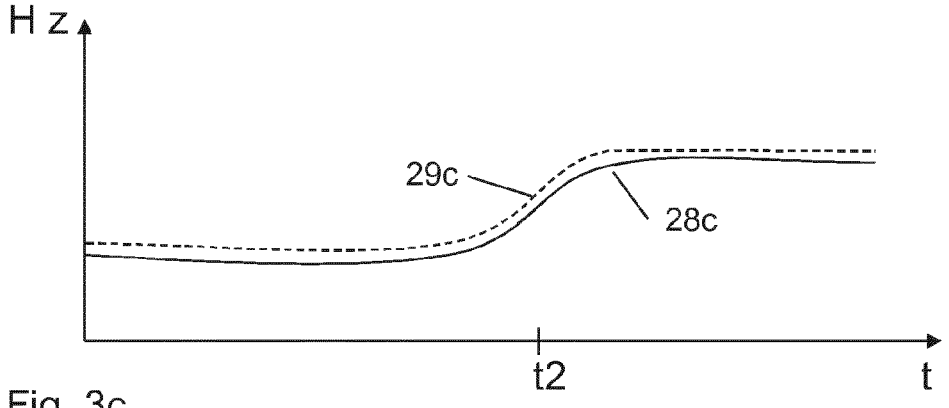

In FIGS. 3*a*, 3*b*, and 3*c*, a measured property pattern and a stored signal pattern over time are shown, wherein FIG. 3*a* shows the magnetic field intensity H in the x-direction, FIG. 3*b* in the y-direction, and FIG. 3*c* in the z-direction. The measured field intensities in each case are shown with a solid line and the stored field intensities of the signal pattern in each case are shown with a broken line. The solid lines 28*a*, 28*b*, and 28*c* thus represent the measured field intensities and the broken lines 29*a*, 29*b*, and 29*c* the stored field intensities in the x-, y-, and z-directions. The measured values are shown smoothed out.

The stored signal pattern (broken lines 29*a*, 29*b*, and 29*c*) contains typical behaviors of field intensities as they occur on approaching a shaft door and entering an elevator car. Shortly before until shortly after the time t2, in which the passenger enters the elevator car, a significant increase in the field intensities in the y- and x-directions may be seen, whereas the field intensity in the x-direction remains quasi unchanged the entire time. The change in field intensities may be attributed in particular to the use of ferromagnetic materials in the elevator car. As is plain in FIGS. 3*a*, 3*b*, and 3*c*, the measured property pattern (solid lines 28*a*, 28*b*, and 28*c*) follows the stored signal pattern quite exactly. This agreement is for the mobile telephone a further indicator that the passenger has entered the elevator car. The comparison of the property pattern with stored signal patterns proceeds analogously to the above described comparison of the motion pattern with stored signal patterns.

Since not all elevator systems have identical property patterns, for these can vary, the measured property pattern is in particular compared not only with one signal pattern, but with a whole series of slightly different signal patterns.

Apart from that, additional further measurement values such as the air pressure, brightness, humidity, or carbon dioxide content of the air can be considered, for example.

A further increase in the reliability of identifying entry into a region of a shaft door or an elevator car can be achieved in that in addition, more measurement values are considered which identify an activity of the elevator system. For example, from the above described magnetic field intensities, an activity pattern can be deduced which is compared with a signal pattern which is typical of opening of the car and shaft doors. Another possibility is to deduce an activity pattern from the sounds measured with the microphone and compare it with a signal pattern that is typical of the opening of car and shaft doors. It can be helpful as with the motion and property patterns to compare the activities patterns with several slightly different signal patterns. Adequate agreement between the measured activity pattern and a stored signal pattern can again be assessed as an indicator that the passenger is located in a region of a shaft door or has entered an elevator car.

The mobile telephone can be configured such that it identifies an entry into a region of a shaft door or an elevator car even if there is a single adequate agreement of a motion pattern, a property pattern, or an activity pattern with a stored signal pattern. It is also possible, however, that entry is only identified when there are at least two, three, or more agreements.

Figure 4:
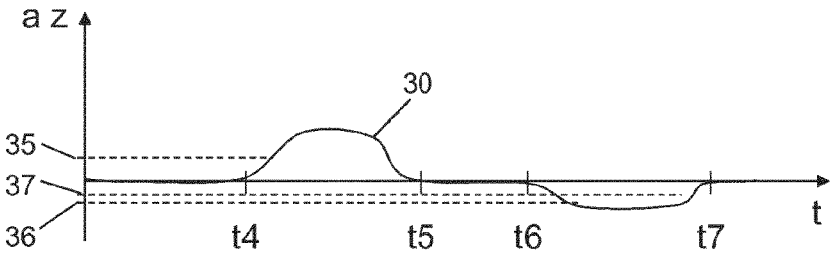
FIG. 4 shows a chronological behavior of an acceleration in a vertical direction during a trip of an elevator car.

In order to make the detection of entry into a region of a shaft door or elevator car more reliable, the stored signal patterns can be adjusted. With an adjustment, the method can in particular be adjusted to the behavior of the owner of the mobile telephone. For this the mobile telephone in particular detects a trip in an elevator car. This can be very reliably detected by monitoring the acceleration in the z-direction and thus in the vertical direction 13. As an example, in FIG. 4 the line 30 shows the course of acceleration a in the z-direction upward, wherein the gravitational acceleration is neglected. The elevator car 11 and thus also the passenger 23 with their mobile telephone 24 starting at time t4 are accelerated at a nearly constant rate. Shortly before the desired speed of the elevator car 11 is reached, the acceleration drops in order to reach the zero line by the time t5. The elevator car 11 then travels up until the time t6 at a constant speed so as then to be braked at a quasi constant negative acceleration until the time t7. This typical course with acceleration in the vertical direction, constant travel, and braking until a standstill can be detected very well in the measurement values.

As soon as travel in an elevator car is detected, motion, activity, and/or property patterns collected prior to travel are compared with stored signal patterns and on the basis of the comparison the stored signal patterns are adjusted with the methods of machine learning. In this process, the stored signal patterns are changed in the direction of the motion, activity, and/or property patterns collected prior to the trip.

Instead of evaluating measurement values of the sensors of the mobile telephone 24 as described, in order to detect that the mobile telephone 24 is located in the region 31 of the shaft door 18*a* or inside the elevator car, the mobile telephone 24 can also receive a signal from a positional information device in the form of a beacon 33 arranged in the elevator car 11. The beacon 33 here in particular transmits a signal that only beacons in an elevator car transmit. As soon as the mobile telephone 24 receives this signal, it knows that it is located in the region of an elevator car 11. As soon as the signal intensity of the received signal exceeds a first threshold value, the mobile telephone 24 identifies that it is located in the elevator car 11. The beacon 33 can also transmit a signal by which it can be identified. If the mobile telephone 24 knows which beacon sent the signal it receives, it can test using stored information whether the beacon is in an elevator car. It is also possible that the information regarding the location of the beacon can be queried from an information module not shown.

Instead of the beacon 33, the door control unit 21 for example, a component of the elevator system 10 can transmit a corresponding signal that is received by the mobile telephone 24 and evaluated as described.

The mobile telephone 24 can also determine its position within the building 9 in which the elevator system is arranged. The mobile telephone 24 thus has a so-called indoor navigation system. The indoor navigation system evaluates signals from a plurality of beacons, not shown, within the building 9 and determines from them the position of the mobile telephone 24 within the building 9. By comparison with a map of the building 9 it can be determined whether the terminal device is located in the region of the shaft door 18*a* or in an elevator car 11.

The mobile telephone 24 can also receive information concerning its position within the building 9 which has the elevator system 10 from a positioning system 34. The building 9 in which the elevator system 10 is installed in this case has the positioning system 34 which can determine the location of the mobile telephone 24. This positioning system 34 transmits information on the position of the mobile telephone 24 to the mobile telephone 24. This information can relate to the position within the building 9 and the mobile telephone 24 can compare the position with a map of the building 9 and deduce from that whether it is located in the region of the shaft door 18*a*. It is also possible that the positioning system 34 transmits the corresponding information directly to the mobile telephone 24 if it is located in the region of the shaft door 18*a* or in the elevator car 11.

Instead of activating measurement of the measurement data at the same time as activation of the measurement mode of the mobile telephone 24, the mobile telephone 24 can start and/or end the measurement of measurement values based on an external signal. This external signal for example is transmitted from the elevator control unit 22 at the start of and at the end of a trip of the elevator car 11 to the mobile telephone 24.

The external signal can also be transmitted at the start of a trip, for example, and contain information on the anticipated duration of the upcoming trip. It is also possible that the external signal is transmitted prior to the start of the trip and contains information about how long it is before the trip starts. In addition, here as well the anticipated duration of the trip can be sent.

It is likewise possible that, using at least one sensor, the mobile telephone 24 already in measurement mode monitors the measurement values which mark the movements of the mobile telephone 24. It begins the collection of measurement values when one start condition dependent on at least one measurement value is fulfilled, and ends collection of measurement values when one end condition dependent on at least one measurement value is fulfilled.

As already described above, FIG. 4 shows a typical course of the acceleration in the z-direction during a trip of an elevator car 11 upward. The measurement of the measurement values is started when the acceleration exceeds a first acceleration threshold value 35 and thus fulfills a start condition. The measurement of the measurement values ends when the acceleration goes below a second acceleration threshold value 36 and then exceeds a third acceleration threshold value 37 and thus fulfills an end condition.

Alternatively, or additionally, the air pressure measured by a barometer can be evaluated for detecting a trip in an elevator car and fulfillment of the start and end conditions can be tested. For example, a start condition can thus be that the amount of gradients of the air pressure exceeds a first gradient threshold value. An end condition could then be, for example, that the amount of the air pressure gradient goes below a second gradient threshold value.

In conclusion it should be pointed out that terms such as "having," "comprising," etc. do not exclude any other elements or steps, and terms such as "one" or "a" do not rule out a plurality. Furthermore, it is pointed out that features or steps which were described with reference to one of the above exemplary embodiments can also be used in combination with other features or steps of above described exemplary embodiments.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for monitoring an elevator system comprising the steps of:

collecting measurement values in an elevator car of the elevator system using at least one sensor of a mobile terminal device;

transmitting the collected measurement values by the mobile terminal device to a central evaluation unit;

evaluating the transmitted measurement values by the evaluation unit; and the mobile terminal device activating a measurement mode, thus preparing the mobile terminal device for the collecting of the measurement values, when the mobile terminal device detects that it is located in a region of a shaft door of the elevator system.

2. The method according to claim 1 wherein the mobile terminal device activates the measurement mode when the mobile terminal device detects that it is located inside the elevator car.

3. The method according to claim 1 where in the mobile terminal device receives and evaluates a signal from a positional information device to determine a position of the mobile terminal device in the elevator system.

4. The method according to claim 1 wherein the mobile terminal device determines its position inside a building including the elevator system and from the determined position the mobile terminal device deduces whether it is located in the region of the shaft door of the elevator system.

5. The method according to claim 1 wherein the mobile terminal device receives information representing its position inside a building including the elevator system from a positioning system and from the received information deduces whether it is located in the region of the shaft door of the elevator system.

6. The method according to claim 1 wherein the mobile terminal device, by the at least one sensor, collects ones of the measurement values that mark movements of the mobile terminal device and, proceeding from the movements measurement values, detects whether it is located in the region of the shaft door of the elevator system.

7. The method according to claim 6 including deducing a motion pattern from the movements measurement values of the mobile terminal device and comparing the motion pattern with at least one stored signal pattern, and basing the detection of whether the mobile terminal device is located in the region of the shaft door on the comparison.

8. The method according to claim 1 wherein the mobile terminal device, by the at least one sensor, collects ones of the measurement values that mark an activity of the elevator system and, proceeding from the activity measurement values, detects whether the mobile terminal device is located in the region of the shaft door of the elevator system.

9. The method according to claim 8 including deducing an activity pattern from the activity measurement values and comparing the activity pattern with at least one stored signal pattern, and basing the detection of whether the terminal device is located in the region of the shaft door on the comparison.

10. The method according to claim 1 wherein the mobile terminal device, utilizing the at least one sensor, collects ones of the measurement values marking properties of an environment of the mobile terminal device and based on the properties measurement values detects whether it is located in the region of the shaft door of the elevator system.

11. The method according to claim 10 including deducing a property pattern from the properties measurement values and comparing the property pattern with at least one stored signal pattern, and basing the detection of whether the terminal device is located in the region of the shaft door on the comparison.

12. The method according to claim 1 wherein the mobile terminal device upon activation of the measurement mode also starts a measurement of the measurement values.

13. The method according to claim 12 wherein the mobile terminal device starts and ends the measurement of the measurement values in response to an external signal.

14. The method according to claim 1 wherein the mobile terminal device utilizes the at least one sensor to monitor ones of the measurement values that mark movements of the mobile terminal device and starts a measurement of the movements measurement values when a start condition dependent on at least one of the measurement values is fulfilled.

15. The method according to claim 1 wherein the mobile terminal device utilizes the at least one sensor to monitor ones of the measurement values that mark movements of the mobile terminal device and ends a measurement of the movements measurement values when an end condition dependent on at least one measurement values is fulfilled.

* * * * *